US009093740B2

(12) United States Patent
Barratt et al.

(10) Patent No.: US 9,093,740 B2
(45) Date of Patent: Jul. 28, 2015

(54) ANTENNA-IN-PACKAGE STRUCTURE

(75) Inventors: Christopher Barratt, Valbonne (FR); Chakib El Hassani, Villeneuve Loubet (FR); Pascal Ciais, Antibes (FR)

(73) Assignee: INSIGHT SIP SAS, Grasse (FR)

( * ) Notice: Subject to any disclaimer, the term of this patent is extended or adjusted under 35 U.S.C. 154(b) by 159 days.

(21) Appl. No.: 13/574,062

(22) PCT Filed: Jan. 19, 2011

(86) PCT No.: PCT/EP2011/050653

§ 371 (c)(1),
(2), (4) Date: Jul. 19, 2012

(87) PCT Pub. No.: WO2011/089141

PCT Pub. Date: Jul. 28, 2011

(65) Prior Publication Data

US 2012/0293392 A1 Nov. 22, 2012

(30) Foreign Application Priority Data

Jan. 20, 2010 (EP) ..... 10305066

(51) Int. Cl.

| | |
|---|---|
| ***H01Q 1/38*** | (2006.01) |
| ***H01Q 1/50*** | (2006.01) |
| ***H01Q 9/04*** | (2006.01) |
| ***H01Q 1/24*** | (2006.01) |
| ***H01Q 9/42*** | (2006.01) |

(52) U.S. Cl.
CPC ..... *H01Q 9/0421* (2013.01); *H01Q 1/243* (2013.01); *H01Q 1/38* (2013.01); *H01Q 9/42* (2013.01)

(58) Field of Classification Search
CPC ..... H01Q 1/243; H01Q 1/42; H01Q 1/0421; H01Q 1/38
See application file for complete search history.

(56) References Cited

U.S. PATENT DOCUMENTS

| | | | | |
|---|---|---|---|---|
| 2,990,547 | A * | 6/1961 | McDougal | 343/767 |
| 6,452,548 | B2 * | 9/2002 | Nagumo et al. | 343/700 MS |
| 6,512,493 | B2 * | 1/2003 | Park et al. | 343/895 |
| 6,917,346 | B2 * | 7/2005 | Izzat et al. | 343/895 |
| 7,218,282 | B2 * | 5/2007 | Humpfer et al. | 343/700 MS |
| 7,362,271 | B2 * | 4/2008 | Iwai et al. | 343/700 MS |
| 2002/0024466 | A1 | 2/2002 | Masuda | |
| 2003/0184482 | A1 * | 10/2003 | Bettin et al. | 343/702 |
| 2004/0227678 | A1 | 11/2004 | Sievenpiper | |

(Continued)

FOREIGN PATENT DOCUMENTS

| | | |
|---|---|---|
| DE | 103 19 093 B3 | 11/2004 |
| EP | 1 936 736 A1 | 6/2008 |

OTHER PUBLICATIONS

International Search Report, dated Jul. 19, 2011, from corresponding PCT application.

*Primary Examiner* — Trinh Dinh
(74) *Attorney, Agent, or Firm* — Young & Thompson

(57) ABSTRACT

An electronic device with an antenna of the antenna-in-package type (AIP) includes an upper surface on which a radiating element is provided. The radiating element has an open end and a feeding end. The antenna also includes an adaptation element. The antenna is characterized in that the adaptation element is provided at an area that is different from the upper surface of the antenna holding the radiating element. The adaptation element is connected, at one end, to an intermediate point of the radiating element and grounded at another end. The device allows a further size reduction of standard inverted F antennas (IFA).

15 Claims, 7 Drawing Sheets

(56) References Cited

U.S. PATENT DOCUMENTS

2006/0017621 A1* 1/2006 Okawara et al. ..... 343/700 MS
2006/0109179 A1 5/2006 Humpfer et al.
2008/0001823 A1* 1/2008 Jung et al. ..... 343/700 MS
2008/0007469 A1 1/2008 Hung et al.

* cited by examiner

Prior Art

ANTENNA-IN-PACKAGE STRUCTURE

FIELD OF THE INVENTION

The present invention relates generally to the field of antennas and more specifically to miniature antennas of the kind used in electronic portable and handheld devices to receive and transmit signals in a multi gigahertz range.

The invention is more particularly related to electronic devices such as miniaturized communication modules or antenna in package.

BACKGROUND OF THE INVENTION

The telecommunications industry has always put an emphasis on the miniaturization of electronic circuits and components. As far as portable and handheld communicating devices are concerned this effort focuses particularly on the antenna which is usually one of the more cumbersome parts of a radio system. Because the trend is also in the reduction of the form factor of these devices the chief difficulty is to maintain antenna performances while they must fit in packages that are becoming increasingly smaller and slimmer. Moreover, all these communicating devices are often bound to embed multiple antennas adapted to the various types of wireless technologies supported which contributes to make their embedding even more difficult to achieve.

Indeed, it is not now infrequent that a cellular phone, e.g.: a GSM mobile phone (Global System for Mobile communications) also embeds a Bluetooth™ short range wireless link to connect the phone to another device; typically, to connect to a personal computer or to a mobile headset. Also, recent high-end mobile phones often include a GPS (Global Positioning System) receiver. And, most of the mobile computers and PDAs (Personal Digital Assistants) are equipped to allow connection to a wireless LAN (Local Area Network), e.g.: a Wi-Fi™ LAN so as to get access to the Internet within buildings and any public areas providing the appropriate wireless access points. Hence, those communicating devices must be equipped of one or more antennas each devised to efficiently operate at a particular wavelength typically in a frequency range as low as 850 MHz ($10^6$ Hertz) for the GSM to 5 GHz ($10^9$ Hertz), i.e., at wavelengths ($\lambda$) ranging respectively from about $\lambda$=35 cm (centimeter=$10^{-2}$ meter) to $\lambda$=6 cm.

The standard way of implementing such an antenna is to draw it under the form of metallic traces on the same printed circuit board (PCB) that holds and links the components of any communicating device. An antenna structure commonly in use for that purpose is called IFA for "inverted F antenna" in reference to its overall shape 110, as shown in FIG. 1, where there is an open end and a grounded end with an intermediate feeding leg. IFA has become popular because it is a quarter wavelength ($\lambda/4$) antenna (thus, contributing to reduce the size occupied accordingly) and because it can conveniently be drawn on a single plane of a PCB. Hence, the name sometime also used of PIFA which stands for "planar inverted F antenna". In this example of an antenna devised to operate at 2.45 GHz, in the middle of the frequency range mentioned above, i.e., at a wavelength of about 12 cm, the overall size occupied by the antenna in this example is just a rectangle of 8 mm by 6 mm (millimeter=$10^{-3}$ meter). Indeed, a significant reduction of the overall dimensions is obtained by folding the antenna as shown 115. Folding, a standard technique, allows a reduction in the order of one-tenth of the wavelength ($\lambda/10$) as illustrated.

Nevertheless, the trend in the evolution of telecommunication components and devices is a constant reduction of their sizes while antennas must still abide by the rules of physics which require that their dimensions remain a finite fraction (¼ for an IFA like antenna) of the wavelength over which they must transmit and receive signals independently of any packaging constraints. A simple scaling of antenna dimensions to fit into a tighter package would indeed seriously impair their performances. This would be very detrimental to the quality and transmission range capability of the communicating device.

More particularly the invention intends to miniaturize systems of the antenna in package type which is a recent technology separate from conventional antenna-on-PCB solutions.

It is thus an object of the present invention to describe a technique that allows a further reduction of the overall space occupied by an antenna without sacrificing any of its electrical and transmission performances.

Further objects, features and advantages of the present invention will become apparent to the ones skilled in the art upon examination of the following description in reference to the accompanying drawings. It is intended that any additional advantages be incorporated herein.

SUMMARY OF THE INVENTION

The invention relates an electronic device comprising:

i. a substrate having a multi-layered wiring structure comprising a first layer and a layer comprising a ground plane;

ii. an electronic circuit comprising a radio transceiver;

iii. a printed antenna;

characterized in that the antenna comprises a radiating element provided at the first layer and an adaptation element provided at a layer of the multi-layered wiring structure that is different from the first layer, said adaptation element configured to match an antenna impedance to an impedance of the electronic circuit.

Possible options of this device are introduced hereafter. They can be cumulated or used alternatively wherein:

- the radiating element comprises an open end and a feeding end.
- the adaptation element is connected to the radiating element at an intermediate point between the open end and the feeding end.
- it comprises at least one interlayer via connecting the adaptation element to the radiating element.
- the adaptation element is located at an inner layer and connected to the ground plane through at least one via.
- the adaptation element is located on the ground plane layer and is connected directly to the ground plane.
- the adaptation element is facing the radiating element.
- the radiating element is a folded wired section comprising plural parallel and joined portions.
- the width of the portions increases from the feeding end towards the open end.
- the adaptation element has a longitudinal direction parallel to said portions.
- the adaptation element is a folded wired section.
- the multilayered wiring structure is laminate substrate.
- the multilayered wiring structure is a ceramic substrate such as LTCC (Low Temperature Coffired Ceramics).
- the antenna is of an antenna-in package type.
- the antenna has a modified inverted F antenna (IFA) shape.
- the first layer is an outer layer of the multilayered wiring structure.

The invention also describes an antenna of the antenna-in-package type (AIP). which comprises an upper surface on which a radiating element is provided. The radiating element has an open end and a feeding end. The antenna also comprises an adaptation element. The antenna is characterized in that the adaptation element is provided at an area that is different from the upper surface of the antenna holding the radiating element. The adaptation element is connected, at one end, to an intermediate point of the radiating element and grounded at another end.

The invention also includes following optional features:

- the area comprising the adaptation element is in a plane different from the plane comprising the upper surface;
- the area comprising the adaptation element is part of an inner layer in a multilayered wiring structure;
- the adaptation element is fitted to the radiating element to match the antenna impedance with the impedance of the multilayered wiring structure and of a radio transceiver using said antenna;
- providing the adaptation element at an area that is different from the upper surface allows reducing size of the antenna without impairing antenna performances;
- providing said adaptation element at an area that is different from the upper surface allows improving antenna performances in an identical available area;

The antenna according to one embodiment is of the type antenna-in-package and is selected from a list comprising: IFA, PIFA, monopole and dipole antennas.

An antenna according to one embodiment is such that said adaptation element is integrated into an electronic circuit and is electrically connected to said AIP antenna.

DETAILED DESCRIPTION

The following detailed description of the invention refers to the accompanying drawings. While the description includes exemplary embodiments, other embodiments are possible, and changes may be made to the embodiments described without departing from the spirit and scope of the invention.

Figure 1:
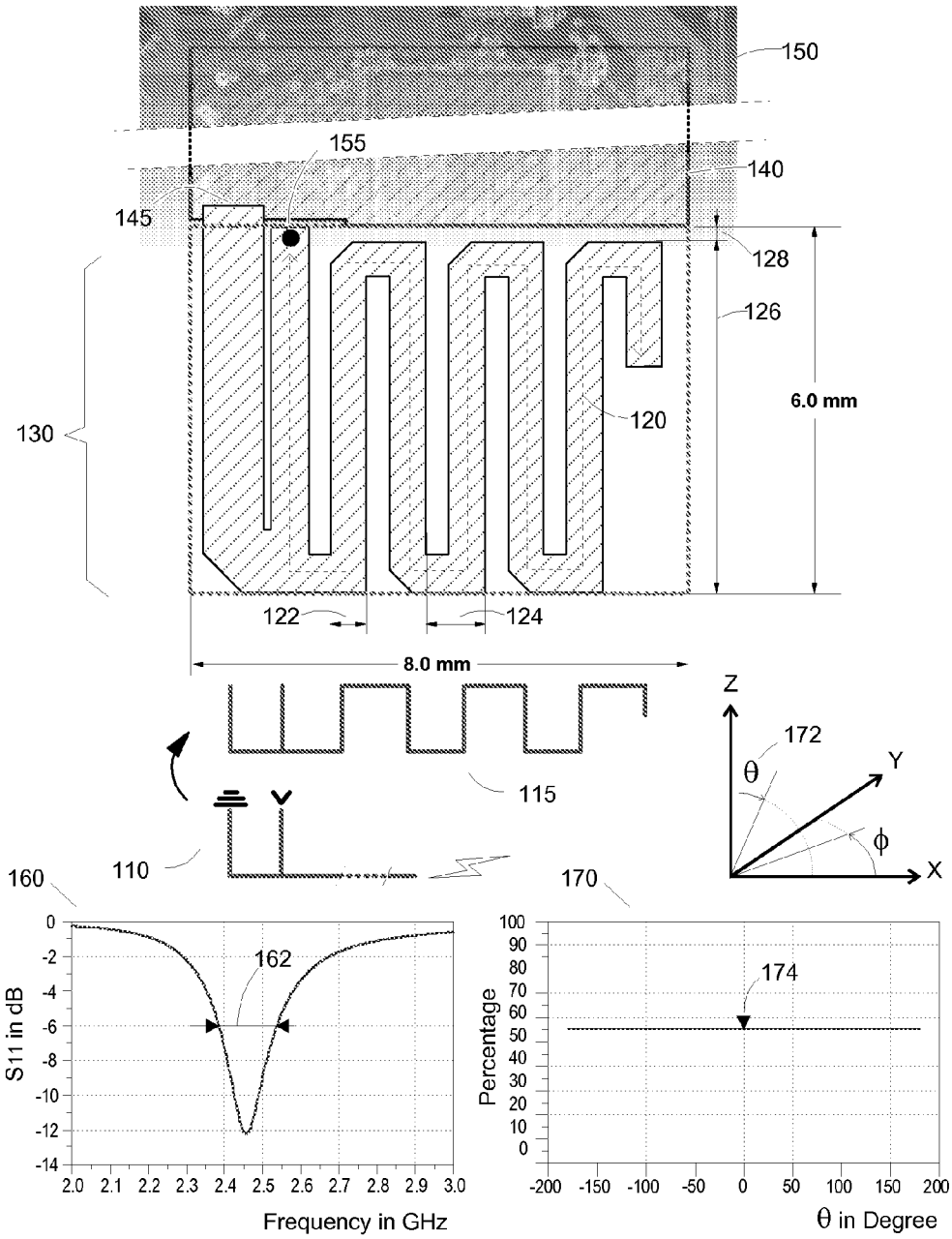
FIG. 1 depicts an example of a standard folded inverted F antenna (IFA) implemented on a printed circuit board along with the respective quality and efficiency curve.

FIG. 1 describes a standard folded inverted F antenna implemented on a PCB, an antenna structure which is largely used in all sorts of handheld and portable communicating devices.

The main parameters of the antenna geometry that allows its best adaptation to the signal wavelength to transmit and receive are shown. In this type of antenna, devised to operate at a quarter of the transmitted wavelength signals, i.e.: about 12 cm in this example of a 2.45 GHz antenna, the length of the folded leg 120 is thus close to 3 cm. The other parameters that participate to the adaptation of the electrical characteristics are: the width of the traces 122; the repetition step of the folded motifs 124; the height of the folded motifs 126; their distance to the PCB ground plane 128. Indeed, to allow the antenna to radiate properly the whole antenna structure 130 is situated off the ground plane 140 of the PCB 150. The grounded end of the antenna is connected, directly or through vias, to the PCB ground plane 145 while the antenna is directly fed, typically from a radio transceiver housed on the PCB, through its intermediate leg 155. This type of structure is often referred to as "antenna in package" (AIP) since it is printed on the same PCB or substrate that holds all the components of the communicating device. Thus, does not require any tuning and skilled personnel when assembled in the communicating box.

The overall behaving of the antenna can be anticipated prior to actual implementation with any of a few commercially available specialized electromagnetic simulation software products that allow an accurate computation of any of its electrical characteristics. One parameter widely used to characterize an antenna is referred to as S11. S11 is one parameter of the so-called scattering parameters (S-parameters) that are commonly used to measure and qualify the behaving of linear passive or active circuits operating at radio frequencies. S-parameters are used to evaluate electrical properties of these circuits such as their gain, return loss, voltage standing wave ratio (VSWR). In a 2-port circuit, S11, one of four possible S-parameters in a 2×2 matrix, measures the input port voltage reflection coefficient. It is generally expressed in decibel (dB) and characterizes the return loss relative to a reference impedance. The lower the value of S11, the better the antenna and the transceiver impedances match. This parameter is plotted in diagram 160 versus the frequency for the exemplary standard inverted F antenna shown in FIG. 1. The measured bandwidth 162, at −6 dB, is here of 154 MHz.

Another key parameter of an antenna is its transmission efficiency. Radiation efficiency is the ratio between the power actually radiated by the antenna versus the one injected by the transceiver through the feeding leg 155. The difference contributes to produce heat that must be dissipated by the antenna resistance. Obviously, the closer to 100% this value the better it is. This parameter is plotted in diagram 170 as a function of the radiation angle in the vertical (Z) plane, referred to as λ 172, measured in degree from the vertical axis. As expected for this type of antenna, the efficiency 174 is constant in the Z plane and is here of 55.3%.

Figure 2:
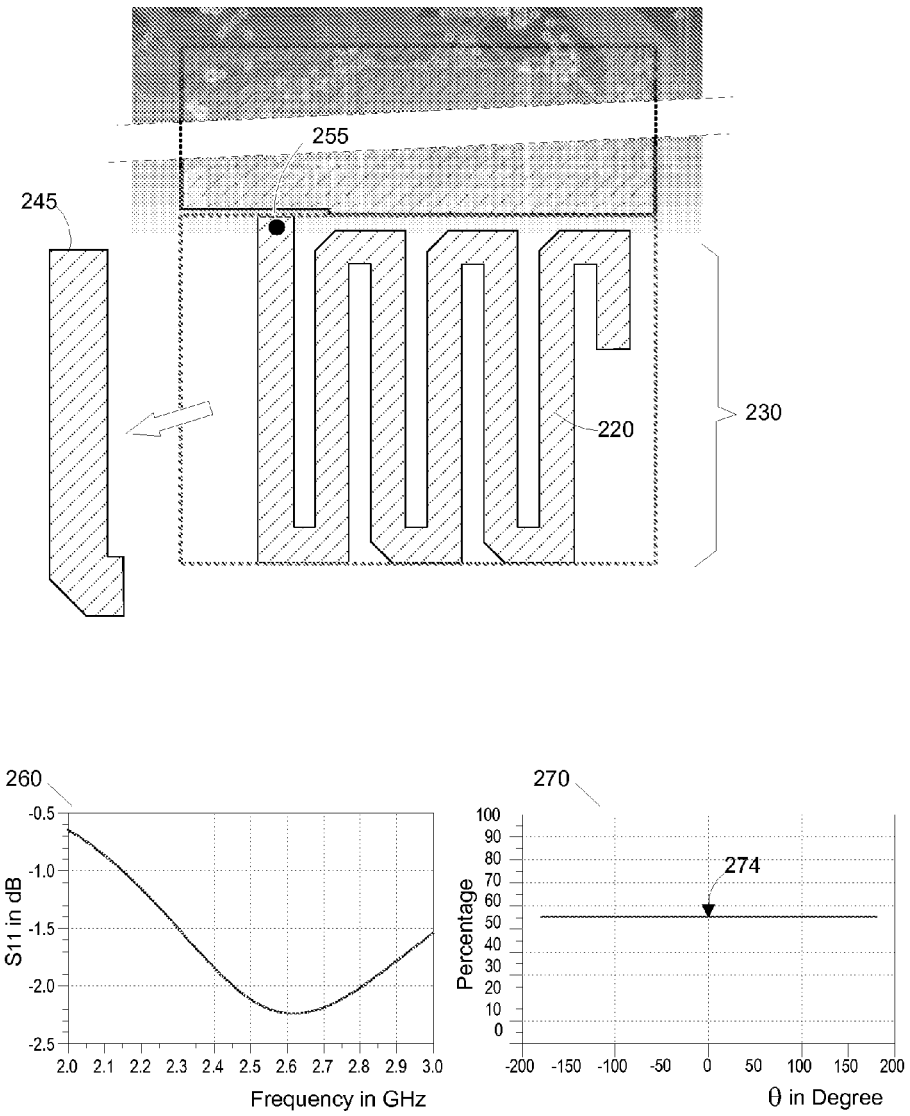
FIG. 2 illustrates the way invention manages to further reduce the size of the exemplary IFA antenna, along with the respective quality and efficiency curve.

FIG. 2 illustrates the way that the invention manages to further reduce the size of the exemplary standard antenna as shown in FIG. 1.

The idea is based on the observation that in such an antenna structure (PIFA like) not all parts are actually radiating. This can be simply proved by performing a simulation of the previous antenna structure from which the grounded leg has been removed 245. The electrical parameters previously considered, namely: S11 and the transmission efficiency, are becoming as shown in 260 and 270 respectively. It should be no surprise that S11, the adaptation between antenna and transceiver impedances, be dramatically degraded versus the standard antenna of FIG. 1. Indeed, it is known that the distance between grounded and feeding legs and in general layout parameters of this part of a PIFA antenna, govern the impedance adaptation. However, what is interesting to notice is that transmission efficiency 270 is not affected by the removing of the ground leg, all other things being identical. It is marginally found lower at 54.6% (instead of 55.3%) 274.

The clear conclusion of this observation is that the ground leg of a PIFA antenna does not participate, even marginally, to the radiation of the antenna since the transmission efficiency is not impaired. Thus, it is possible to distinguish between a non radiating part, i.e., the grounded leg 245 and a radiating part comprised of the folded motifs 220 and of the feeding leg 255.

Figure 3:
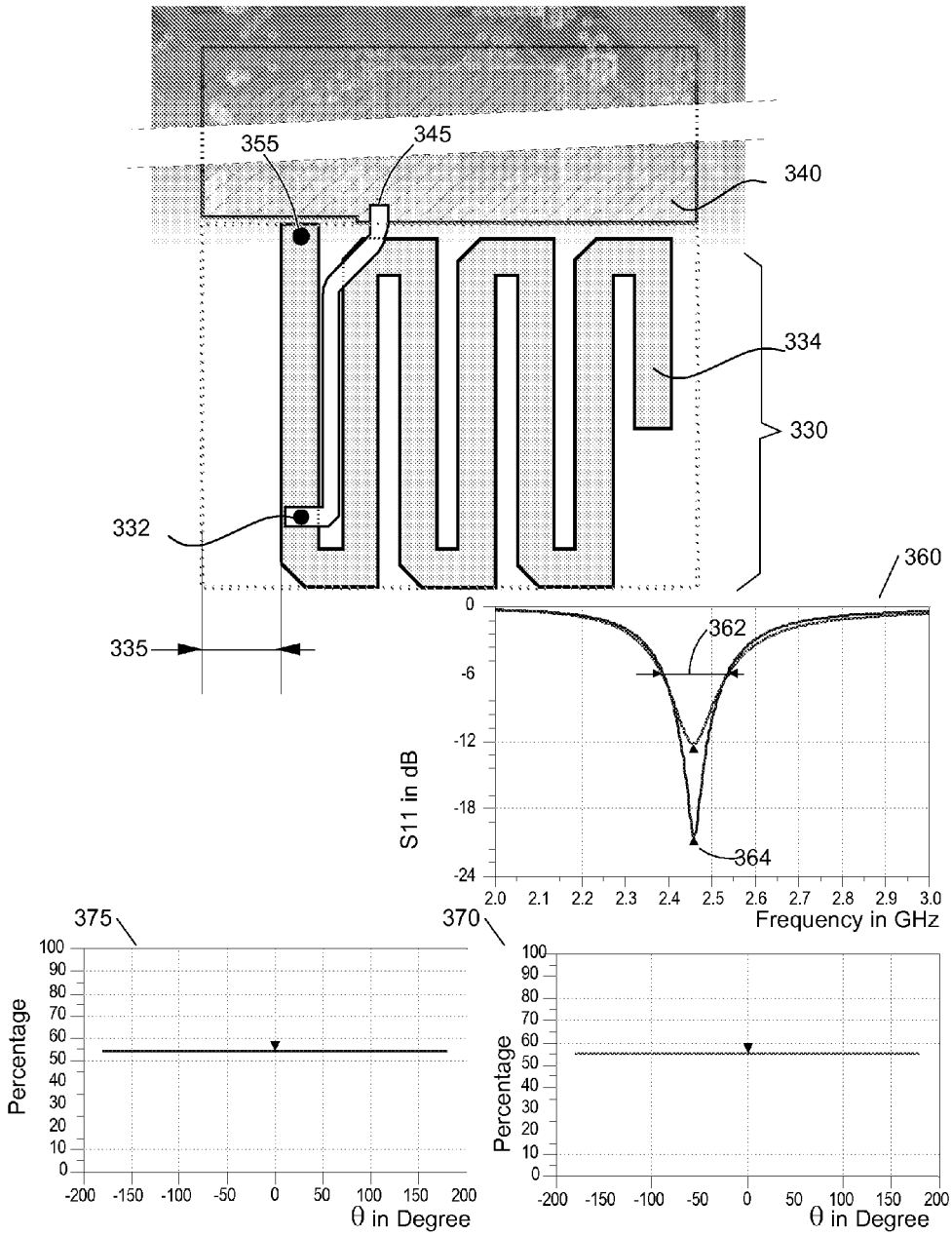
FIG. 3 illustrates how a good impedance adaptation can be retrieved with the modified antenna structure of the invention along with the respective quality and efficiency curve.

FIG. 3 illustrates how a good impedance adaptation can be retrieved with a modified radiating antenna structure, printed on a single plane or layer of the laminate substrate (PCB), which takes advantage of the above observation. In this structure a point 332 of the radiating folded trace situated on the feeding leg ending with feeding end 355 is grounded with a metallic trace 345 that needs not to be on the same plane as the radiating part of the antenna though. Thus, saving the corresponding area 335 that used to be occupied by the removed grounded leg. Hence, the antenna of the invention is comprised, on a same plane of the PCB, of a radiating trace having a feeding end 355, an open end 334 and an intermediate connection point 332 that is grounded through a non radiating 20 trace or element 345 situated on another plane of the PCB.

The non-radiating element or matching element 345 acts as an adaptation element for matching the impedance of the antenna to input impedance of the rest of the device.—i.e.—the electronic circuit embedded in the device. The electronic circuit typically includes components such as a radio transceiver and printed wired traces serving as electrical links. In an embodiment, the device comprises a first layer 330 where the radiating element is located and at least one layer 320 (consisting in or incorporating the ground plane). At least one of the first layer 310 and the ground plane layer 320 may be an outer layer of the multilayered wiring structure.

The results obtained are shown in diagrams 360, 370 and 375. They compare the electrical characteristics of the reference exemplary antenna of FIG. 1 with the ones found for the new structure.

The efficiency remains identical and found to be marginally lower at 54.3% for the new structure 375 versus the one 370 of FIG. 1 where efficiency is of 55.3%.

As far as parameter S11 is concerned, while the bandwidth at −6 dB remains identical 362, the adaptation is even better with a significantly lower value of this parameter 364, value of which is −20.4 dB while it was −12.2 dB.

Figure 4:
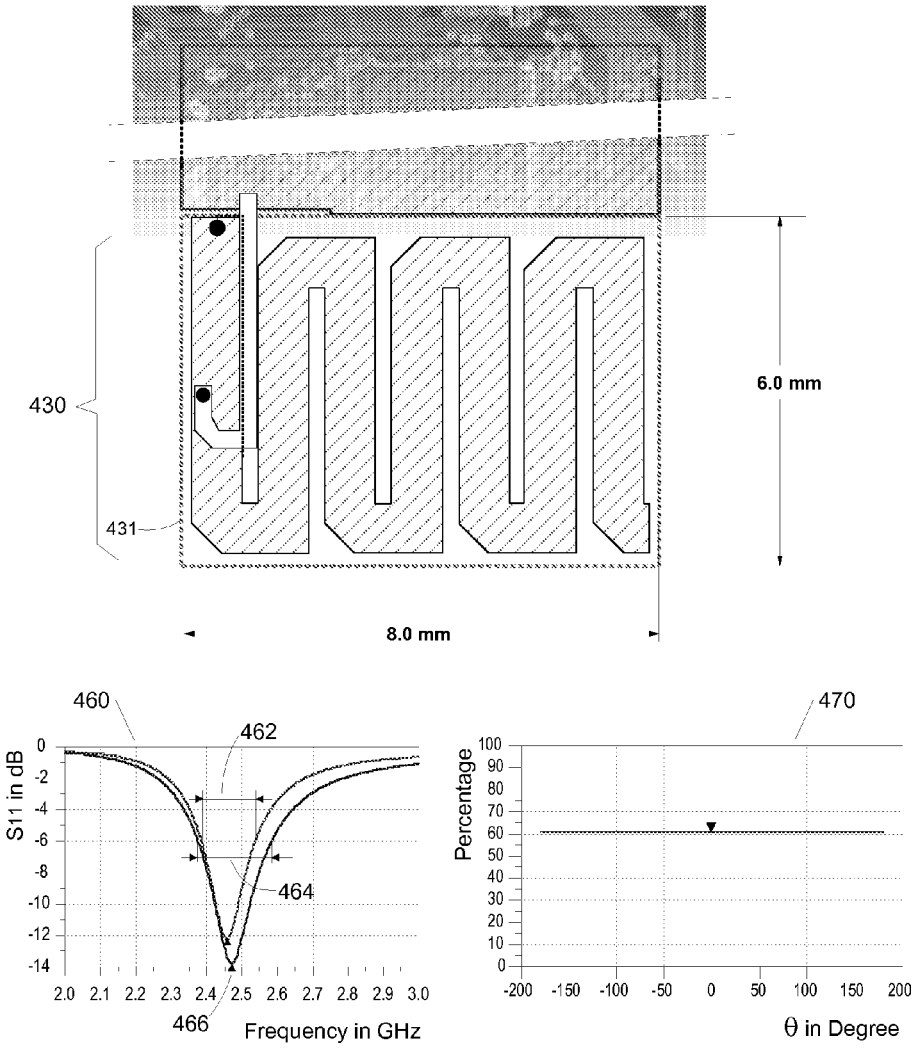
FIG. 4 illustrates an alternate way of using the available area to obtain better results in term of transmission efficiency, showed along with the respective quality and efficiency curve.

FIG. 4 illustrates an alternate way of using the invention in which the available area 431 (6×8 mm) is used to obtain a better result in term of transmission efficiency 470. In this case the same folded antenna structure 430 is enlarged to occupy the whole available area. The efficiency obtained here is of 60.5% to be compared with the efficiency of 55.3% of the device shown in FIG. 1. The feeding leg 455 is grounded in a similar way as illustrated in previous FIG. 3.

Parameter S11 and the bandwidth of this antenna are shown in diagram 460. Bandwidth 464 is compared to the bandwidth 462 of the reference antenna of FIG. 1 and found to be slightly wider. The adaptation is also slightly better, as in reference number 466, and found to be of −13.8 dB at 2.47 GHz. The slight shift observed of the central frequency, from 2.45 GHz for the reference antenna, can easily be corrected by further adjusting the geometry of the antenna.

Figure 5:
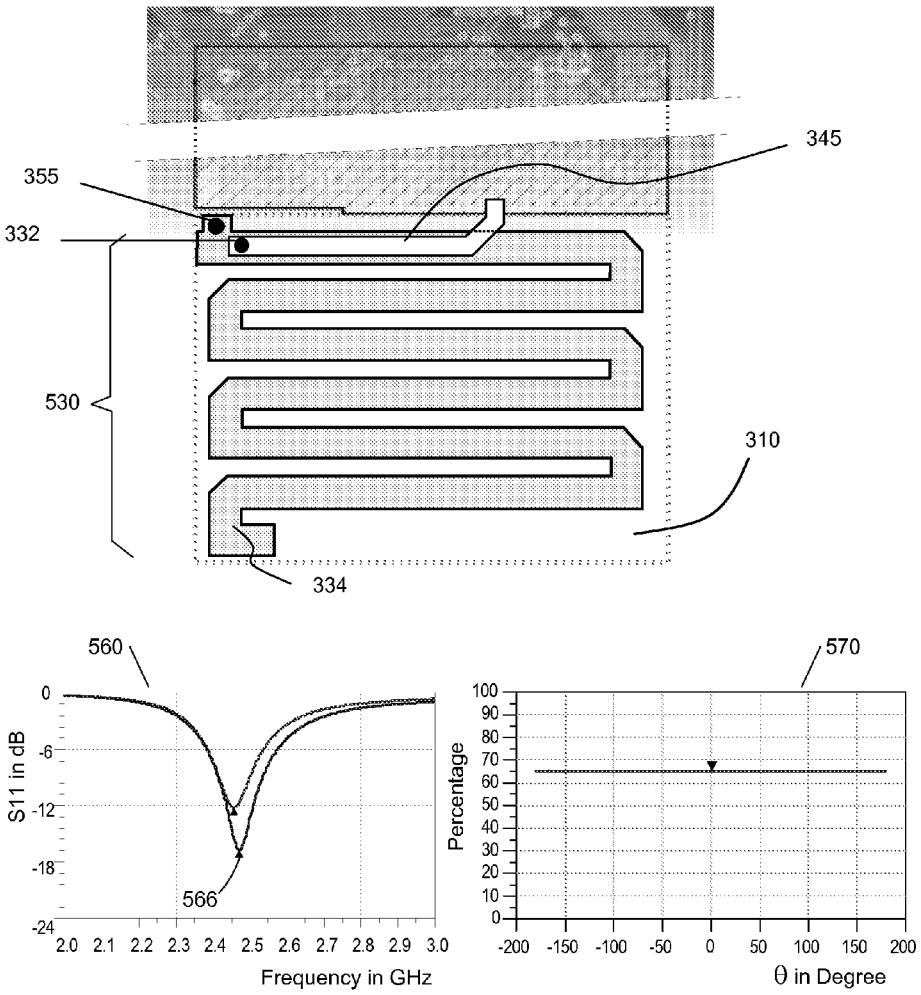
FIG. 5 illustrates yet another usage of the available area to implement an antenna according to the invention, showed along with the respective quality and efficiency curve.

FIG. 5 illustrates with reference number 530, yet another usage of the available area to implement an antenna according to the invention. The transmission efficiency 570 is further increased to reach 65.0% so well above the efficiency of a conventional device as shown in FIG. 1 with an efficiency of about 55.3%. The behavior of parameter S11 is, as shown at 560, similar to what was observed in FIG. 4, i.e., an increase of the bandwidth and a better adaptation with a low value of −16.8 dB and a slight shift of the central frequency to 2.47 GHz.

According to this embodiment, the radiating element—which is still a printed wired element—has a folded structure extending from the feeding end 355 located above the ground plane 340 towards the open end 334 which is located at an area of the layer opposite the area facing the ground plane. The folded structure comprises a plurality of parallel sections oriented transversally compared to the situation of previous figures. And the adaptation element has a longitudinal main direction that is parallel to the sections of the folded radiating elements.

It is advantageous that the adaptation element and the radiating element face each other since it optimizes the reduction of space needed for the whole antenna structure.

Figure 6:
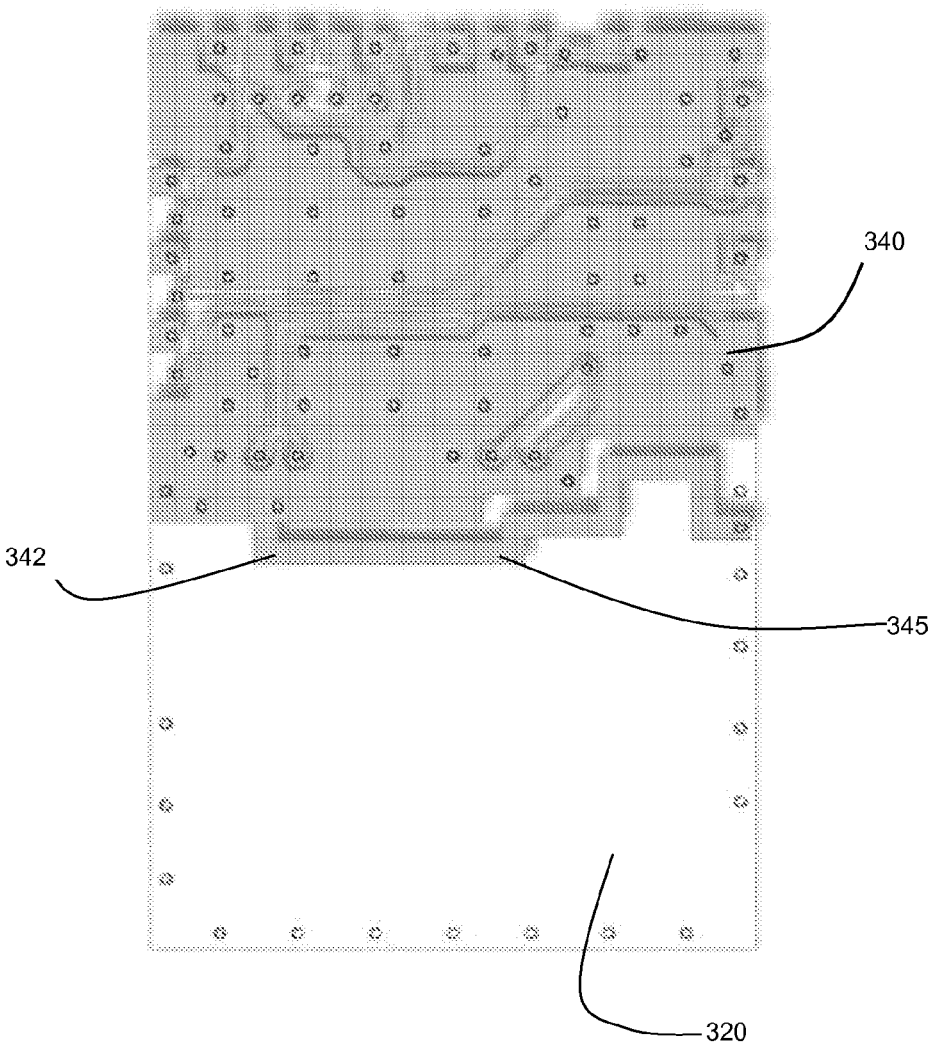
FIG. 6 depicts another embodiment with respect to the adaptation element.

Even if the radiating element advantageously exhibits a folded shape, this case is not limiting the invention. However, in the case it is folded, a main direction is preserved and called longitudinal direction. In this context, FIG. 6 shows a further embodiment with a refined shape for the adaptation element 345. The element is here formed with printed wired sections folded at right angle with a longitudinal direction bordering the ground plane 340.

FIG. 6 also shows that the adaptation element 345 may be included in a layer 320 situated under the first layer 310. In this embodiment, the layer 320 of the substrate incorporates the ground plane 340 but the ground does not cover the whole surface area of the layer 320. Indeed, a portion of the layer 320 is not covered by the conducting ground surface and is simply an insulated portion. The adaptation element 345 is located at the border between the ground surface referenced 340 and the free surface of the layer 320, thus facing a preferably small area of the radiating element of the antenna. The ground plane 340 and the adaptation element 345 are directly connected at 342.

According to another embodiment, the radiating element comprises a folded wired section made of several parallels portions and the width of the portions is increasing from the feeding end 355 to the open end 334. This optimizes the efficiency of the antenna. The width increase may be continuous along the radiating element. By way of example the width of the terminal portion of the antenna may be between 1.5 and 3 times wider than the width of the first portion (the one of the feeding leg 455).

Figure 7:
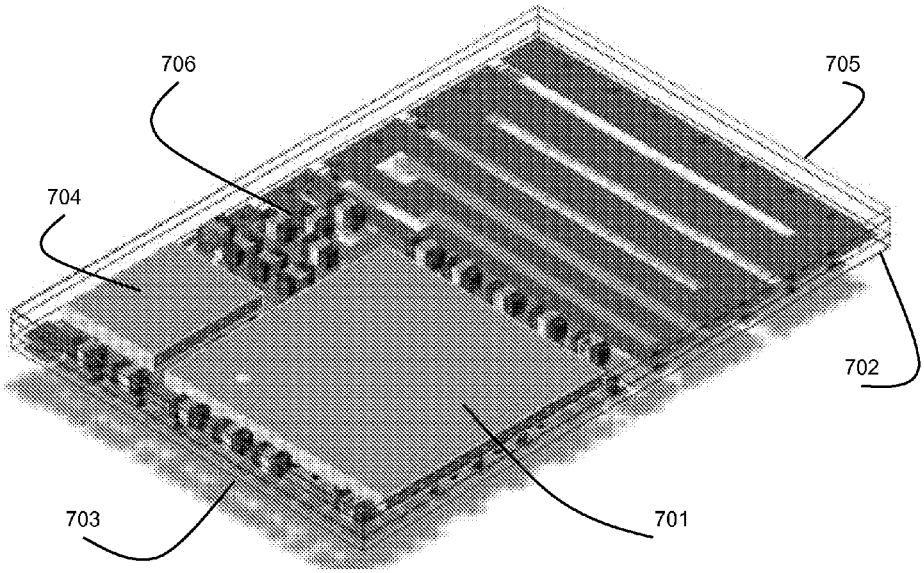
FIG. 7 shows an embodiment of integration of the antenna in an electronic device.

FIG. 7 shows an embodiment of the device according to the invention wherein the radiating element of the antenna is located on a first layer of a laminate substrate 702. This layer also receives a transceiver 701, an oscillator 704 such as crystal and possibly electronic components of the surface mount technology. Underlayers comprise a layer 320 incorporating the ground plane 340 and connection pads 703 for external connections. An overmold 705 is used to encapsulate the entire circuit of the board thus forming an overmolded packaging.

Hence, the structure of the invention allows a reduction of the area occupied by an antenna or, within the same available area, an improvement of the bandwidth and efficiency of the antenna, all other things being equal.

It should be understood that the embodiments described herein are merely exemplary and that various modifications may be made without departing from the scope of the invention.

What is claimed is:

1. Electronic device comprising:

i. a substrate having a multi-layered wiring structure comprising a first layer and a layer comprising a ground plane;

ii. an electronic circuit comprising a radio transceiver; and iii. a printed antenna;

wherein the antenna comprises a radiating element provided at the first layer and a non-radiating element that does not participate actively in the antenna radiation and that is physically separated from the radiating element and that is provided at a second layer of the multi-layered wiring structure that is different from the first layer such that at least a portion of the non-radiating element is at the second layer in vertical registration with and facing the radiating element located on the first layer, said non-radiating element configured to match an antenna impedance to an impedance of the electronic circuit, and wherein the radiating element comprises an open end and a feeding end, and wherein the non-radiating element comprises a first end that is connected to the radiating element at an intermediate point between the open end and the feeding end and a second end that is connected to the ground plane, and wherein the radiating element is a folded wired section comprising plural straight portions that are parallel to each other along a predetermined direction and joined to each other by joining portions.

2. Electronic device according to claim 1 comprising at least one interlayer via connecting the portion of the non-radiating element at the second layer that is in vertical registration with the radiating element at the first layer.

3. Electronic device according to claim 2 wherein the non-radiating element is located on the second layer and is connected directly to the ground plane.

4. Electronic device according to claim 1 wherein the non-radiating element is located completely on the layer comprising the ground plane and is connected directly to the ground plane, the ground plane being the second layer.

5. Electronic device according to claim 1 wherein first end of the non-radiating element is at the second layer in vertical registration with and facing the radiating element located on the first layer; and the second end of non-radiating element is at the second layer and is not in vertical registration with the radiating element.

6. Electronic device according to claim 1 wherein a width dimension of the plural straight portions of said radiating element increases from the feeding end towards the open end, the width dimension being perpendicular to the predetermined direction.

7. Electronic device according to claim 6 wherein the width dimension is parallel to the ground plane.

8. Electronic device according to claim 1 wherein the non-radiating element has a longitudinal direction parallel to said plural straight portions.

9. Electronic device according to claim 1 wherein the non-radiating element is a folded wired section.

10. Electronic device according to claim 1 wherein the multilayered wiring structure is a laminate substrate.

11. Electronic device according to claim 1 wherein the multilayered wiring structure is a ceramic substrate.

12. Electronic device according to claim 1 wherein the antenna is of an antenna in-package package type.

13. Electronic device according to claim 1 wherein the antenna has a modified inverted-F antenna (IFA) shape.

14. Electronic device according to claim 1 wherein the first layer is an outer layer of the multilayered wiring structure.

15. Electronic device according to claim 1 wherein the non-radiating element is located on the second layer and is connected directly to the ground plane.

* * * * *